US010698436B1

(12) United States Patent
Ye et al.

(10) Patent No.: US 10,698,436 B1
(45) Date of Patent: Jun. 30, 2020

(54) KNOB DEVICE

(71) Applicant: PEGATRON CORPORATION, Taipei (TW)

(72) Inventors: Long-Sing Ye, Taipei (TW); Tao-Hsiang Tang, Taipei (TW)

(73) Assignee: PEGATRON CORPORATION, Taipei (TW)

( * ) Notice: Subject to any disclaimer, the term of this patent is extended or adjusted under 35 U.S.C. 154(b) by 0 days.

(21) Appl. No.: 16/702,315

(22) Filed: Dec. 3, 2019

(30) Foreign Application Priority Data

Jan. 25, 2019 (TW) ..... 108201218 U

(51) Int. Cl.
*G05G 1/10* (2006.01)
*H01H 25/06* (2006.01)

(52) U.S. Cl.
CPC ..... *G05G 1/10* (2013.01); *H01H 25/065* (2013.01)

(58) Field of Classification Search
CPC ... G05G 1/08; G05G 1/10; G05G 1/12; F24C 7/08; H01H 3/10; H01H 3/08; H01H 19/14; H03J 1/14
See application file for complete search history.

(56) References Cited

U.S. PATENT DOCUMENTS 3,158,034 A * 11/1964 Williamson ..... H01H 25/06 74/10 R
6,114,869 A 9/2000 Williams et al.
9,753,483 B1 * 9/2017 Thomas ..... F41G 1/38
2009/0205461 A1 * 8/2009 Windauer ..... F41G 1/38 74/553
2009/0229387 A1 * 9/2009 Lee ..... B60K 37/06 74/89.2
2019/0086945 A1 * 3/2019 Nieh ..... H01H 19/54

FOREIGN PATENT DOCUMENTS

TW 200533923 10/2005

OTHER PUBLICATIONS

"Pogo pin," Wikipedia page, obtained Mar. 5, 2020.*

* cited by examiner

*Primary Examiner* — Richard W Ridley
*Assistant Examiner* — Brian J McGovern
(74) *Attorney, Agent, or Firm* — J.C. Patents

(57) ABSTRACT

A knob device includes a lower cover assembly, an upper cover assembly, a limiting member and an annular member. The lower cover assembly includes a first stopping portion. The upper cover assembly is rotatably stacked on the lower cover assembly along an axis. The upper cover assembly has multiple fixing holes. The limiting member is located between the upper cover assembly and the lower cover assembly and fixed to the lower cover assembly. The limiting member includes a body and a second stopping portion extending from the body. The second stopping portion and first stopping portion are arranged up and down along the axis. The annular member is arranged around the body, and the annular member is rotatably arranged between the first stopping portion of the lower cover assembly and the second stopping portion. The first stopping portion and the second stopping portion limit the annular member on the axis. The annular member includes multiple pogo pins retractably protruding from an outer surface. The pogo pins extend into the fixing holes of the upper cover assembly to fix the annular member to the upper cover assembly.

10 Claims, 5 Drawing Sheets

KNOB DEVICE

CROSS-REFERENCE TO RELATED APPLICATION

This application claims the priority benefit of Taiwan application serial no. 108201218, filed on Jan. 25, 2019. The entirety of the above-mentioned patent application is hereby incorporated by reference herein and made a part of this specification.

BACKGROUND

Technical Field

The present disclosure relates to a knob device, and more particularly to a knob device with pogo pins.

Related Art

Generally speaking, knob, as a common structure in daily life, is extensively applied to various products such as digital media devices, home appliances and automobiles. In part of fields, apparatuses such as volume control knobs in studios and knob regulation devices for high-tech devices have higher using requirements on knob regulation accuracy. Therefore, how to use the easy-to-mold and cost-effective manufacturing methods and structural design to increase the accuracy of knob adjustment is one of the important requirements today.

In addition, in most cases, a rotating hand-feeling of a knob assembly is very important for an ordinary user when a knob regulation device is used. However, mutually linked components of a conventional shuttle knob structure are mostly combined in a screw locking manner, a torsion may be generated during fixation of a screw, and an excessively strong locking force may cause structural deformation and interference with another component to affect the rotating hand-feeling. Moreover, if the knob assembly is designed by use of a structure that is complex in assembling and disassembling, durability of the knob assembly may be affected.

SUMMARY

The present disclosure provides a knob device, which has the advantages of easiness for mounting, stable structure and high dimensional accuracy and can reduce the probability of nonuniform rotating torsion.

A knob device of the present disclosure includes a lower cover assembly, an upper cover assembly, a limiting member and an annular member. The lower cover assembly includes a first stopping portion. The upper cover assembly is rotatably stacked on the lower cover assembly along an axis, and the upper cover assembly has multiple fixing holes. The limiting member is located between the upper cover assembly and the lower cover assembly and fixed to the lower cover assembly. The limiting member includes a body and a second stopping portion extending from the body. The second stopping portion and the first stopping portion are arranged up and down along the axis. The annular member is arranged around the body of the limiting member, and the annular member is rotatably arranged between the first stopping portion of the lower cover assembly and the second stopping portion of the limiting member. The annular member is limited by the first stopping portion of the lower cover assembly and the second stopping portion of the limiting member on the axis. The annular member includes multiple pogo pins retractably protruding from an outer surface, and the pogo pins extend into the fixing holes of the upper cover assembly to fix the annular member to the upper cover assembly.

Based on the above, the upper cover assembly of the knob device of the present disclosure is fixed to the annular member, and the limiting member is fixed to the lower cover assembly. The annular member is limited between the first stopping portion of the upper cover assembly and the second stopping portion of the limiting member, and the annular member is rotatably arranged at the limiting member, so that the upper cover assembly can drive the annular member to rotate relative to the limiting member and the lower cover assembly to achieve a good rotating effect. In addition, the knob device of the present disclosure adopts the pogo pins instead of a common screw locking manner, so that the probability that the annular member is structurally deformed by an improper screw locking force during assembling to further cause interference and unsmooth rotation to affect a rotating hand-feeling is greatly reduced.

In order to make the aforementioned features and advantages of the present disclosure comprehensible, embodiments accompanied with accompanying drawings are described in detail below.

DETAILED DESCRIPTION

The abovementioned and other technical contents, features and effects of the present disclosure will be clearly presented in the following detailed descriptions made to an exemplary embodiment with reference to the accompanying drawings. The directional terms mentioned in the following embodiment, like "above", "below", "left", "right", "front", and "back", refer to the directions in the appended drawings. Therefore, the directional terms are only used for illustration instead of limiting the present disclosure.

Figure 1:
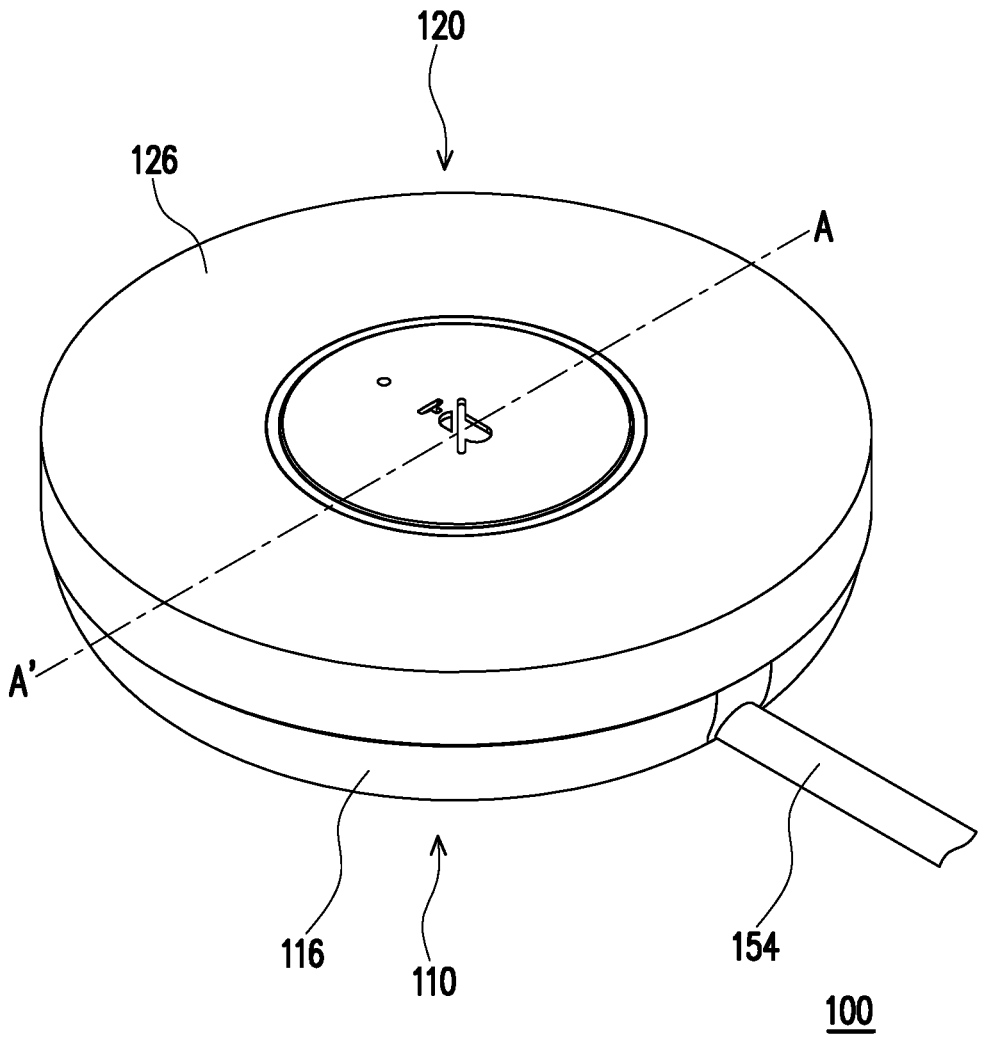
FIG. 1 is a schematic diagram of a knob device according to an embodiment of the present disclosure.
Figure 2:
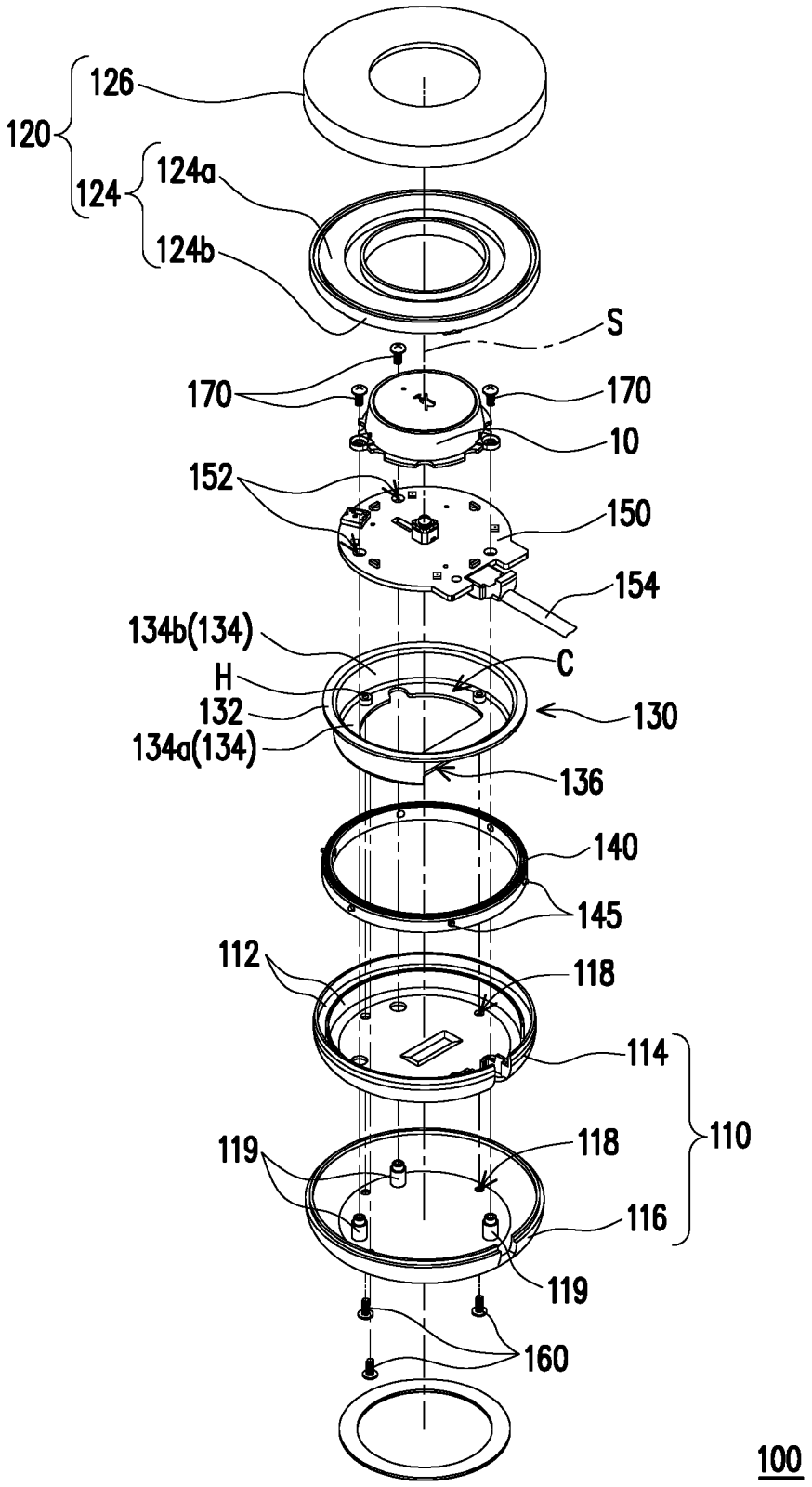
FIG. 2 is an exploded view of the knob device in FIG. 1.
Figure 3:
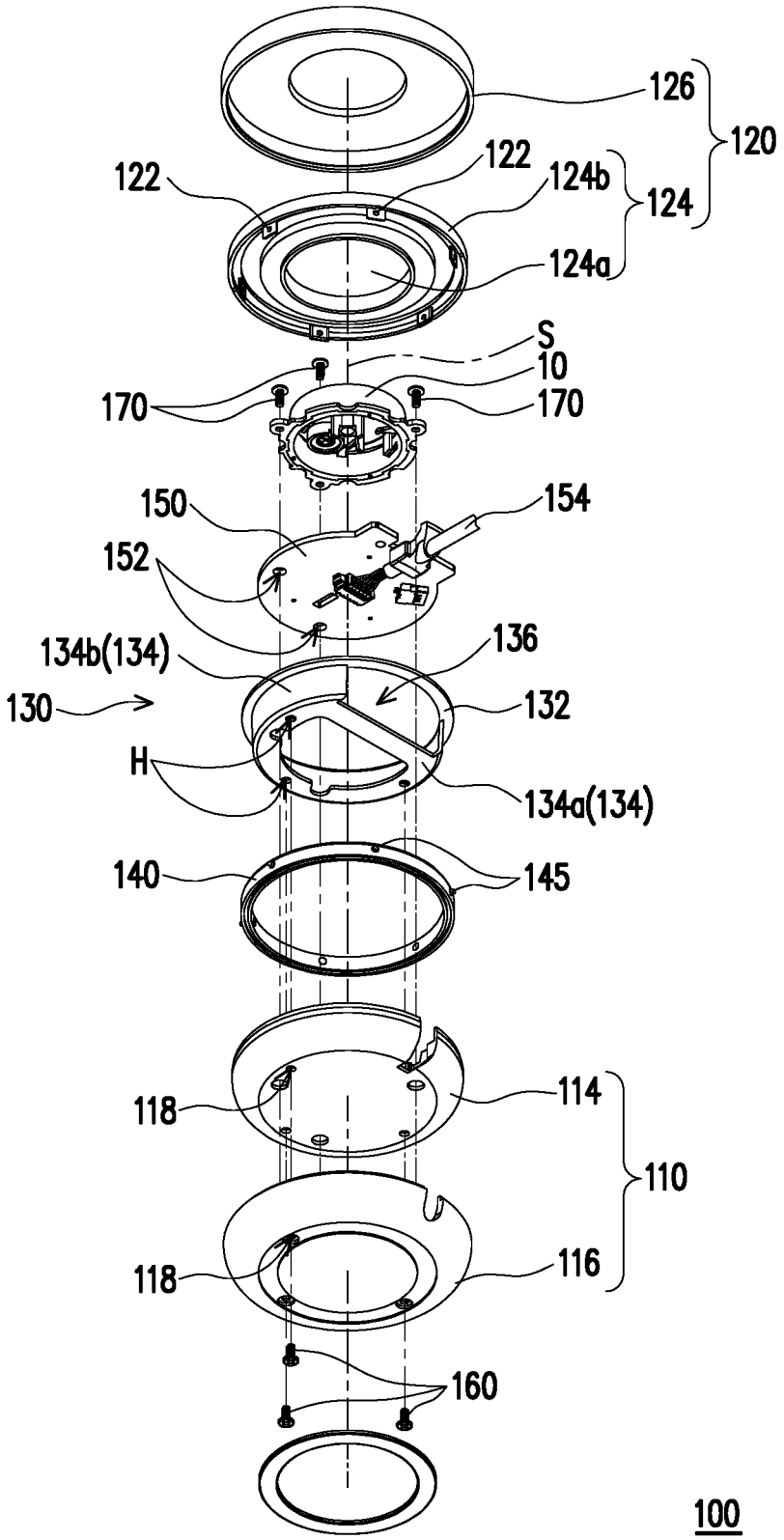
FIG. 3 is an exploded view of the knob device in FIG. 1 from another viewing angle.

FIG. 1 is a schematic diagram of a knob device according to an embodiment of the present disclosure. FIG. 2 is an exploded view of the knob device in FIG. 1. FIG. 3 is an exploded view of the knob device in FIG. 1 from another viewing angle. It is to be noted that the knob device of the present disclosure may be applied to any device with a regulation function, for example, a digital media device, a home appliance and an automobile. Here, a knob device 100 with a button in FIG. 1 is shown as an example only. However, in other embodiments, the knob device may be properly designed according to demands. Application of the knob device is not limited in the present disclosure.

Referring to FIGS. 2 to 3, the knob device 100 includes an upper cover assembly 120, a lower cover assembly 110, a limiting member 130 and an annular member 140. Further, the upper cover assembly 120 is rotatably stacked on the lower cover assembly 110 along an axis S. The limiting member 130 has a body 134. As shown in FIG. 2, the annular member 140 is arranged around the body 134 of the limiting member 130 along the axis S, and both the limiting member 130 and the annular member 140 are located between the upper cover assembly 120 and the lower cover assembly 110.

In this embodiment, the knob device 100 further includes multiple first locking members 160, and the lower cover assembly 110 has multiple first through holes 118. The body 134 of the limiting member 130 further has a bottom wall 134*a* and a sidewall 134*b* protruding from the bottom wall 134*a*, and multiple screw holes H (FIG. 3) corresponding to the multiple first through holes 118 are formed in the bottom wall 134*a* of the limiting member 130. In this embodiment, the first locking members 160 pass through the corresponding first through holes 118 and are screwed to the corresponding screw holes H to fix the limiting member 130 to the lower cover assembly 110.

In addition, as shown in FIG. 2 and FIG. 3, in this embodiment, the knob device 100 further optionally includes a circuit board 150 and a button 10 arranged on the circuit board 150. The bottom wall 134*a* of the limiting member 130 and the sidewall 134*b* of the limiting member 130 enclose an accommodation space C, the circuit board 150 is arranged in the accommodation space C of the limiting member 130, and the limiting member 130 includes a hole 136 through which a wire 154 of the circuit board 154 passes. In this embodiment, the knob device 100 may be, for example, a reception device or a broadcast device, the button 10 may be, for example, a mute button, and the upper cover assembly 120 is rotated for volume control. Of course, in other embodiments, the design of the button 10 can be adjusted according to practical demands. The present disclosure is not limited thereto.

In this embodiment, the circuit board 150 further has a second through hole 152, and the lower cover assembly 110 has a locking hole 119 corresponding to the second through hole 152. Multiple second locking members 170 pass through the corresponding second through hole 152 and locked to the locking hole 119 to fix the circuit board 150 to the lower cover assembly 110. Of course, optionally, in other embodiments, a fixing manner for the circuit board 150 may adopt, for example, clamping or other suitable fixing means. In addition, in an embodiment that is not shown, the knob device 100 may also be applied to a device without the circuit board 150. The present disclosure is not limited thereto.

In addition, in this embodiment, the upper cover assembly 120 may include an inner upper cover 124 and an outer upper cover 126, and the lower cover assembly 110 may include an inner lower cover 114 and an outer lower cover 116. Of course, optionally, in other embodiments, the upper cover assembly 120 may also be integrally formed or be a single component, and is not required to be formed by combining the inner upper cover 124 and the outer upper cover 126; and similarly, the lower cover assembly 110 may also be integrally formed or be a single component, and is not required to be formed by combining the inner lower cover 114 and the outer lower cover 116. The designs of both the upper cover assembly 120 and the lower cover assembly 110 may be adjusted according to practical demands. The present disclosure is not limited thereto.

In this embodiment, a material of the inner upper cover 124 may optionally be different from a material of the outer upper cover 126, and a material of the inner lower cover 114 may also optionally be different from a material of the outer lower cover 116. For example, in this embodiment, the materials of the inner upper cover 124 and the inner lower cover 114 may be plastic, and this is because a plastic material is easy to process and form, a manufacturing procedure thereof is relatively low in cost and the dimension of each detail structure formed on the inner upper cover 124 and the inner lower cover 114 can be controlled accurately. In addition, in this embodiment, for a requirement on attractive appearance of a product, the materials of the inner upper cover 124 and the inner lower cover 114 in this embodiment may be metal. In other words, the knob device 100 of the present disclosure may combine the appearance, the cost and an accurate knob regulation function.

Of course, in other embodiments, the inner upper cover 124 and the inner lower cover 114 may use the same material, and the outer upper cover 126 and the outer lower cover 116 may use the same material. The materials of the outer upper cover 126, the outer lower cover 116, the inner upper cover 124 and the inner lower cover 114 may be adjusted according to practical demands. The present disclosure is not limited thereto.

Figure 4:
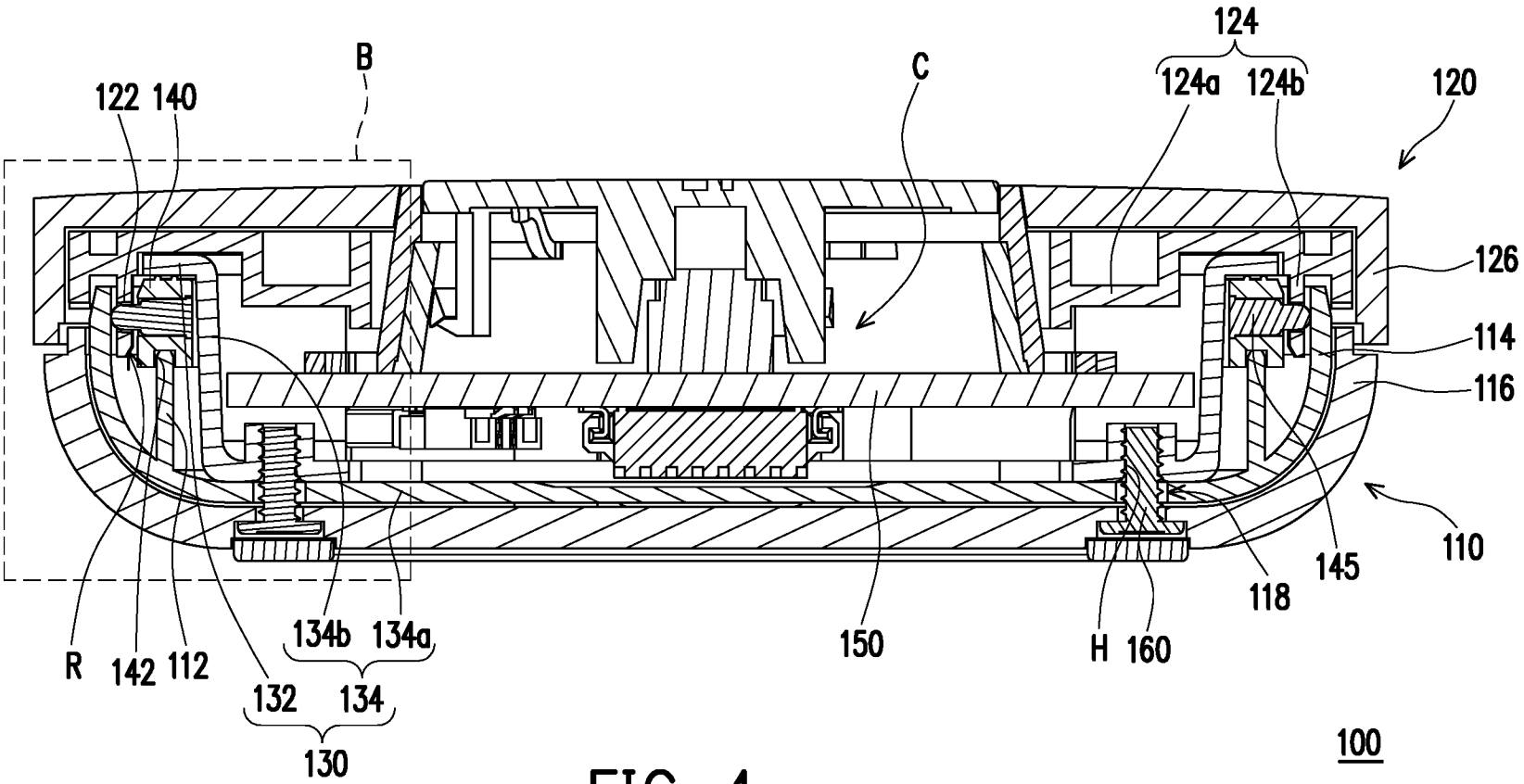
FIG. 4 is a sectional view of the knob device in FIG. 1 along an A-A' section.
Figure 5:
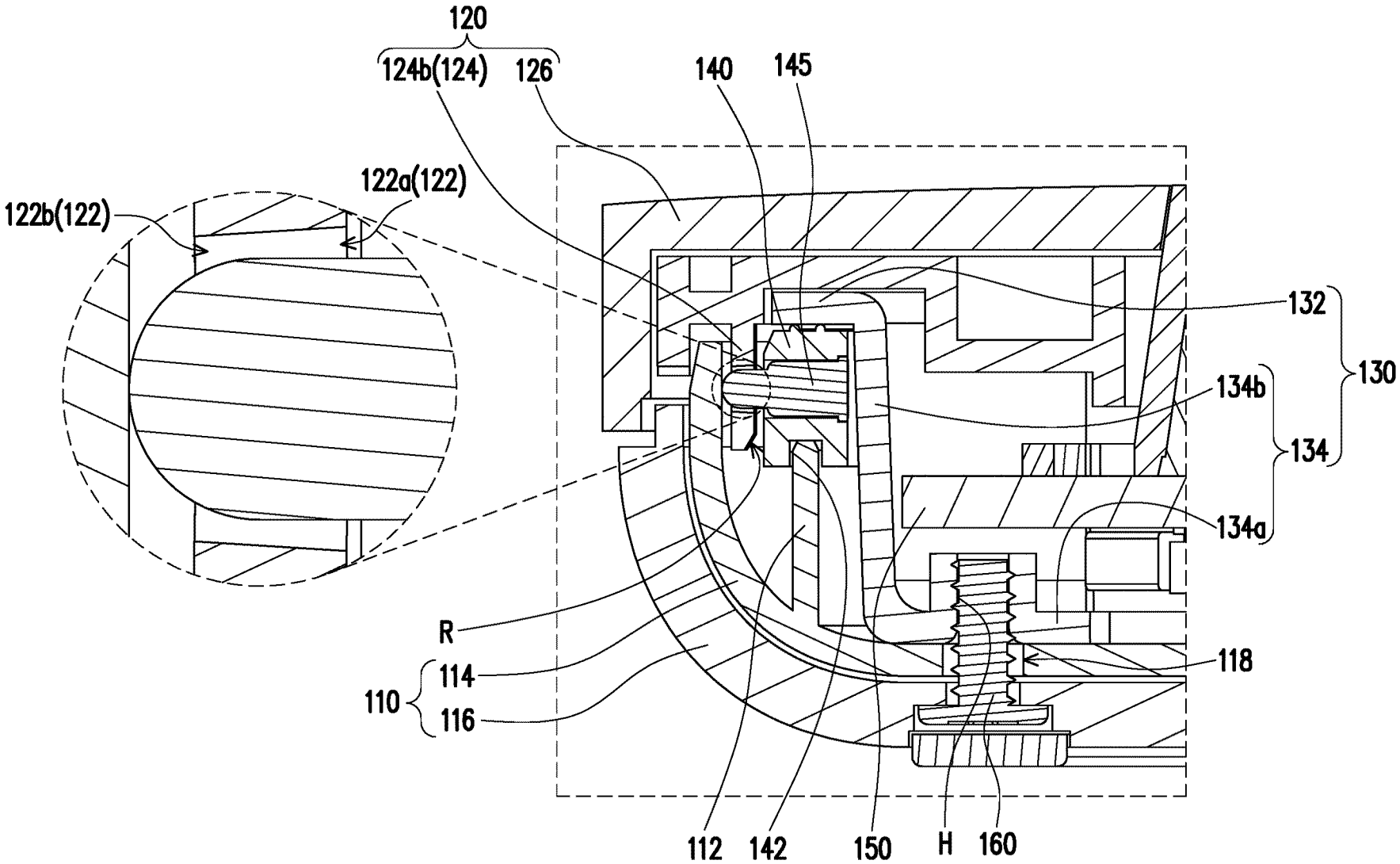
FIG. 5 is an enlarged view of a region B in FIG. 4.

FIG. 4 is a sectional view of the knob device in FIG. 1 along an A-A' section. FIG. 5 is an enlarged view of a region B in FIG. 4. In addition, referring to FIG. 2, FIG. 4 and FIG. 5, in this embodiment, the lower cover assembly 110 further has a first stopping portion 112, and the limiting member 130 further has a second stopping portion 132 extending from the sidewall 134*b* of the body 134 along a direction perpendicular to the axis S (FIG. 2). In this embodiment, the second stopping portion 132 bends and extends outwards from a top end of the sidewall 134*b*. From FIG. 5, it can be seen that the first stopping portion 112 and the second stopping portion 132 are arranged up and down along the axis S.

In this embodiment, the annular member 140 is rotatably arranged between the first stopping portion 112 of the lower cover assembly 110 and the second stopping portion 132 of the limiting member 130 along the axis S. Of course, in other embodiments, an extending direction of the second stopping portion is not required to be perpendicular to the axis S as long as the annular member 140 can be limited and the annular member 140 can be rotatably arranged between the first stopping portion 112 and the second stopping portion 132. The present disclosure is not limited thereto.

In other words, in this embodiment, the annular member 140 is limited on the axis S by the first stopping portion 112 of the lower cover assembly 110 and the second stopping portion 132 of the limiting member 130. In addition, as shown in FIG. 5, the annular member 140 further includes a rail portion 142, and the annular member 140 is rotatably arranged on the first stopping portion 112 in a sliding manner by use of the rail portion 142 thereof. Therefore, the annular member 140 can stably rotate around the axis S between the first stopping portion 112 and the second stopping portion 132, and will not form interference by excessive leftward and rightward displacement to make it impossible for the knob device 100 to rotate smoothly.

In addition, referring to FIG. 3 and FIG. 5, in this embodiment, the inner upper cover 124 further has a disk body 124*a* and multiple protruding portions 124*b* extending from the disk body 124*a* to a direction opposite to the outer upper cover 126 along the axis S, and each of the protruding portions 124*b* has a fixing hole 122. It can be understood that the protruding portion 124*b* shown in this embodiment is only one form and, in other embodiments, the protruding portion 124*b* may completely or partially surround the disk body 124*a* of the inner upper cover 124. The present disclosure is not limited thereto. Moreover, the annular member 140 further includes multiple pogo pins 145 retractably protruding from an outer surface of the annular member 140, and these pogo pins 145 extend into the fixing holes 122 of the upper cover assembly 120 to fix the annular member 140 to the upper cover assembly 120.

When a user rotates the upper cover assembly 120, the limiting member 130 is fixed to the lower cover assembly 110 and will not rotate, and the upper cover assembly 120 drives, through the protruding portions 124*b*, the pogo pins 145 of the annular member 140 to rotate around the axis S. In other words, the upper cover assembly 120 and the annular member 140 rotate relative to the lower cover assembly 110 and limiting member 130 that are fixed, and the annular member 140 is limited by the first stopping portion 112 of the lower cover assembly 110 and the second stopping portion 132 of the limiting member 130 in a direction of the axis S. Therefore, the upper cover assembly 120 can stably rotate relative to the lower cover assembly 110, so that the knob device 100 of the present disclosure has a good rotating regulation hand-feeling.

In addition, referring to FIG. 5, in this embodiment, an end of the protruding portion 124*b* of the upper cover assembly 120 further has an inclined surface R, and the inclined surface R faces the annular member 140. Specifically, in an assembling process, the annular member 140 may sleeve the body 134 of the limiting member 130 at first, and in such case, the pogo pin 145 protrudes from the outer surface of the annular member 140. Then, an assembling operator may cover the lower cover assembly 110 with the upper cover assembly 120. The inclined surface R of the protruding portion 124*b* of the upper cover assembly 120 contacts with and pushes the pogo pin 145 in a mounting process of the upper cover assembly 120 such that the pogo pin 145 retracts into the annular member 140. When the fixing hole 122 of the protruding portion 124*b* moves downwards to the corresponding pogo pin 145, the pogo pin 145 is released from urging of the wall surface of the protruding portion 124*b*, and elastic potential energy accumulated when the pogo pin 145 is deformed is released such that the pogo pin 145 protrudes from the outer surface of the annular member 140 again and naturally extends into the fixing hole 122 of the upper cover assembly 120 to fix the upper cover assembly 120 to the annular member 140.

Therefore, designing the inclined surface R of the protruding portion 124*b* can reduce the probability that assembling is affected by interference between the pogo pin 145 and the protruding portion 124*b* in the assembling process of the upper cover assembly 120, and the knob device 100 can further be assembled more easily.

In addition, it is to be noted that the protruding portion 124*b* of this embodiment is designed in such a manner that the pogo pin 145 is clamped into the fixing hole 122 in a single direction only. That is, after the upper cover assembly 120 and the annular member 140 are fixed, user cannot disassemble the upper cover assembly 120 and the annular member 140, in order to solve the problem of poor rotation caused by high disassembling frequency or improper reassembling. Of course, in other embodiments, it is not limited thereto.

Moreover, as shown in FIG. 5, in this embodiment, the fixing hole 122 of the upper cover assembly 120 has a first end 122*a* close to the limiting member 130 and a second end 122*b* opposite to the first end 122*a*, and an aperture of the first end 122*a* is slightly greater than an aperture of the second end 122*b*. Further, designing different apertures for the fixing hole 122 can allow the pogo pin 145 to extend into the fixing hole 122 of the upper cover assembly 120 smoothly from the first end 122*a* with the relatively great aperture, to achieve an auxiliary assembling effect.

Based on the above, the upper cover assembly of the knob device of the present disclosure is fixed to the annular member, and the limiting member is fixed to the lower cover assembly. The annular member is limited between the first stopping portion of the upper cover assembly and the second stopping portion of the limiting member, and the annular member is rotatably arranged at the limiting member, so that the upper cover assembly can drive the annular member to rotate relative to the limiting member and the lower cover assembly to achieve a good rotating effect. In addition, the knob device of the present disclosure adopts the pogo pins instead of a common screw locking manner, so that the probability that the annular member is structurally deformed by an improper screw locking force during assembling to further cause interference and unsmooth rotation to affect a rotating hand-feeling is greatly reduced.

The present disclosure has been disclosed above with the embodiments but is not limited thereto. A person of ordinary skill in the art may make some modifications and embellishments without departing from the spirit and scope of the present disclosure. Therefore, the scope of protection of the present disclosure should be defined by the appended claims.

What is claimed is:

1. A knob device, comprising:

a lower cover assembly, comprising a first stopping portion;

an upper cover assembly, rotatably stacked on the lower cover assembly along an axis, and the upper cover assembly comprising a plurality of fixing holes;

a limiting member, located between the upper cover assembly and the lower cover assembly and fixed to the lower cover assembly, the limiting member comprising a body and a second stopping portion extending from the body and the second stopping portion and the first stopping portion being arranged up and down along the axis; and an annular member, arranged around the body of the limiting member and rotatably arranged between the first stopping portion of the lower cover assembly and the second stopping portion of the limiting member, the annular member being limited by the first stopping portion of the lower cover assembly and the second stopping portion of the limiting member on the axis and the annular member comprising a plurality of pogo pins retractably protruding from an outer surface of the annular member, wherein the pogo pins extend into the fixing holes of the upper cover assembly to fix the annular member to the upper cover assembly.

2. The knob device according to claim 1, wherein the upper cover assembly further comprises an inner upper cover and an outer upper cover fixed to the inner upper cover, the fixing holes are formed in the inner upper cover, and a material of the inner upper cover is different from a material of the outer upper cover.

3. The knob device according to claim 2, wherein the inner upper cover comprises a disk body and a plurality of protruding portions extending from the disk body to a direction opposite to the outer upper cover along the axis, and the fixing holes are formed in the protruding portions.

4. The knob device according to claim 3, wherein each protruding portion has an inclined surface at an end, and the inclined surface faces the annular member.

5. The knob device according to claim 1, wherein each fixing hole comprises a first end close to the limiting member and a second end opposite to the first end, and an aperture of the first end is greater than an aperture of the second end.

6. The knob device according to claim 1, wherein the annular member has a rail portion, and the rail portion is rotatably arranged at the first stopping portion in a sliding manner.

7. The knob device according to claim 1, wherein the lower cover assembly further comprises an inner lower cover and an outer lower cover fixed to the inner lower cover, the first stopping portion is formed at the inner lower cover, and a material of the inner lower cover is different from a material of the outer lower cover.

8. The knob device according to claim 1, further comprising a circuit board, wherein the body of the limiting member comprises a bottom wall and a sidewall protruding from the bottom wall, the bottom wall and the sidewall enclose an accommodation space, and the circuit board is located in the accommodation space.

9. The knob device according to claim 8, further comprising a plurality of first locking members, wherein the lower cover assembly has a plurality of first through holes, the bottom wall comprises a plurality of screw holes corresponding to the first through holes, and the first locking members pass through the first through holes and are screwed to the screw holes to fix the limiting member to the lower cover assembly.

10. The knob device according to claim 1, further comprising a circuit board and a second locking member, wherein the circuit board comprises a second through hole, the lower cover assembly has a locking hole, and the second locking member passes through the second through hole of the circuit board and is fixed to the locking hole of the lower cover assembly.

* * * * *